US010131148B2

(12) United States Patent
Yoshiike

(10) Patent No.: US 10,131,148 B2
(45) Date of Patent: Nov. 20, 2018

(54) LIQUID DISCHARGE HEAD, LIQUID DISCHARGE DEVICE, AND LIQUID DISCHARGE APPARATUS

(71) Applicant: Masataka Yoshiike, Kanagawa (JP)

(72) Inventor: Masataka Yoshiike, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/607,923

(22) Filed: May 30, 2017

(65) Prior Publication Data

US 2017/0348973 A1 Dec. 7, 2017

(30) Foreign Application Priority Data

Jun. 4, 2016 (JP) ..... 2016-112308
Nov. 18, 2016 (JP) ..... 2016-225515
Apr. 5, 2017 (JP) ..... 2017-074904

(51) Int. Cl.

*B41J 25/34* (2006.01)
*B41J 2/175* (2006.01)
*B41J 2/14* (2006.01)
*B41J 2/165* (2006.01)

(52) U.S. Cl.

CPC ..... *B41J 2/16517* (2013.01); *B41J 2/1433* (2013.01); *B41J 2/175* (2013.01); *B41J 2/17553* (2013.01); *B41J 25/34* (2013.01); *B41J 2002/16502* (2013.01)

(58) Field of Classification Search

CPC ..... B41J 2/16517; B41J 25/34; B41J 2/175; B41J 2/1433; B41J 2/17553

See application file for complete search history.

(56) References Cited

U.S. PATENT DOCUMENTS

2015/0375505 A1* 12/2015 Takahashi ..... B41J 2/055 239/302
2016/0096386 A1* 4/2016 Yoshiike ..... B41J 25/34 347/37
2017/0066266 A1 3/2017 Yoshiike
2017/0076478 A1 3/2017 Yamamoto et al.

FOREIGN PATENT DOCUMENTS

JP 2006-103275 4/2006
JP 2009-184213 8/2009
JP 2010-099880 5/2010
JP 2011-189636 9/2011
JP 2012-176544 9/2012
JP 2016-026912 2/2016

OTHER PUBLICATIONS

U.S. Appl. No. 15/363,282, filed Nov. 29, 2016.

* cited by examiner

*Primary Examiner* — Jason Uhlenhake

(74) *Attorney, Agent, or Firm* — Cooper & Dunham LLP

(57) ABSTRACT

A liquid discharge head includes a head body, a cover, a rib, and a sealer. The head body discharges liquid. The head body includes a frame. The cover is mounted on the frame of the head body. The rib is disposed at the frame along a peripheral surface of the cover. The sealer is disposed between the peripheral surface of the cover and a peripheral surface of the rib.

17 Claims, 16 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2016-112308, filed on Jun. 4, 2016, 2016-225515, filed on Nov. 18, 2016, and 2017-074904, filed on Apr. 5, 2017, in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

When a plurality of components (members) are bonded together to form a liquid discharge head, it is necessary to prevent liquid from entering the inside of the liquid discharge head from a bonded area.

SUMMARY

In an aspect of the present disclosure, there is provided a liquid discharge head that includes a head body, a cover, a rib, and a sealer. The head body discharges liquid. The head body includes a frame. The cover is mounted on the frame of the head body. The rib is disposed at the frame along a peripheral surface of the cover. The sealer is disposed between the peripheral surface of the cover and a peripheral surface of the rib.

In another aspect of the present disclosure, there is provided a liquid discharge device that includes the liquid discharge head.

In still another aspect of the present disclosure, there is provided a liquid discharge apparatus that includes the liquid discharge device to discharge liquid.

In still another aspect of the present disclosure, there is provided a liquid discharge apparatus that includes the liquid discharge head to discharge liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
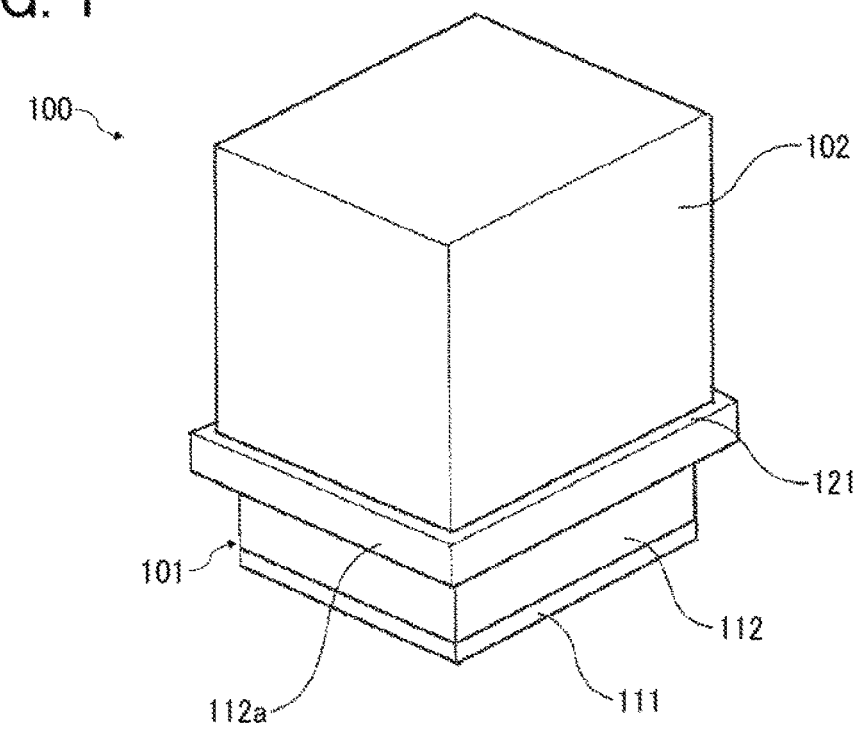
FIG. 1 is a perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
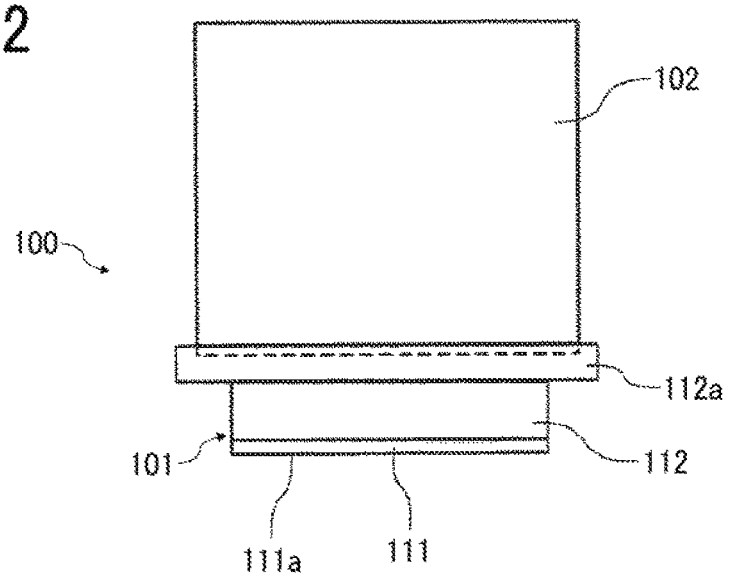
FIG. 2 is a side view of the liquid discharge head of FIG. 1.
Figure 3:
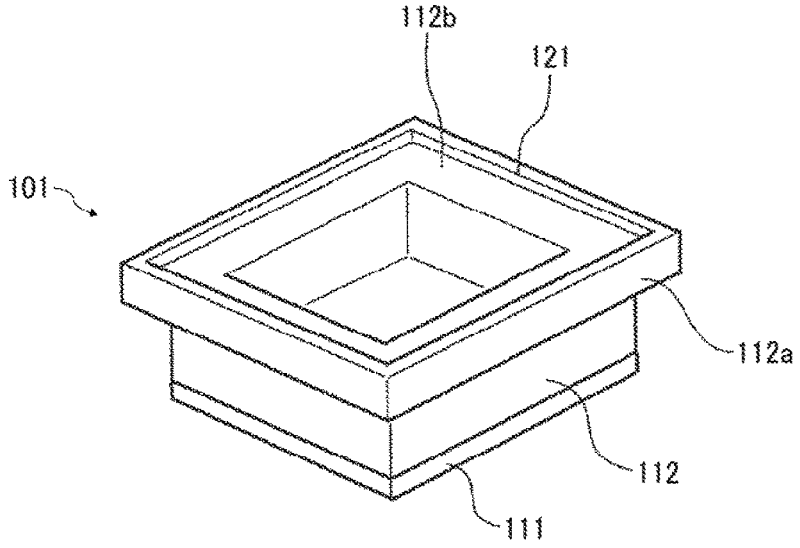
FIG. 3 is a perspective view of a head body of the liquid discharge head of FIG. 1.
Figure 4:
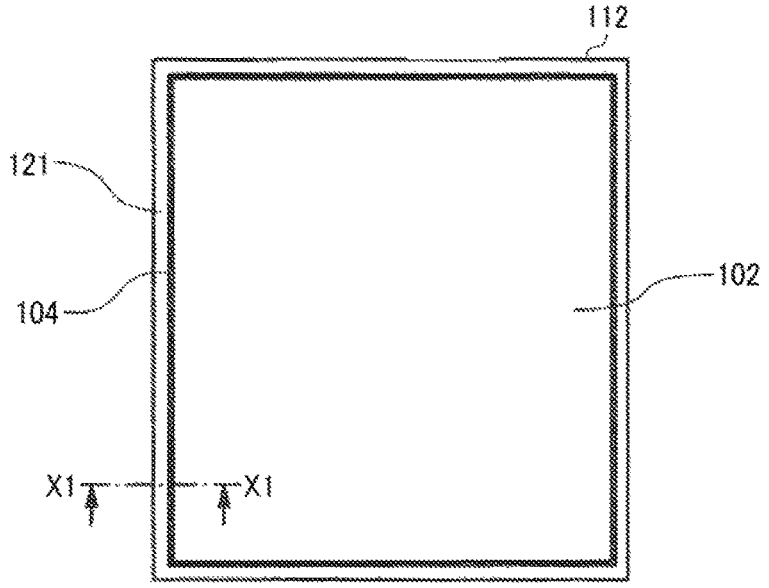
FIG. 4 is a plan view of the liquid discharge head of FIG. 1.
Figure 5:
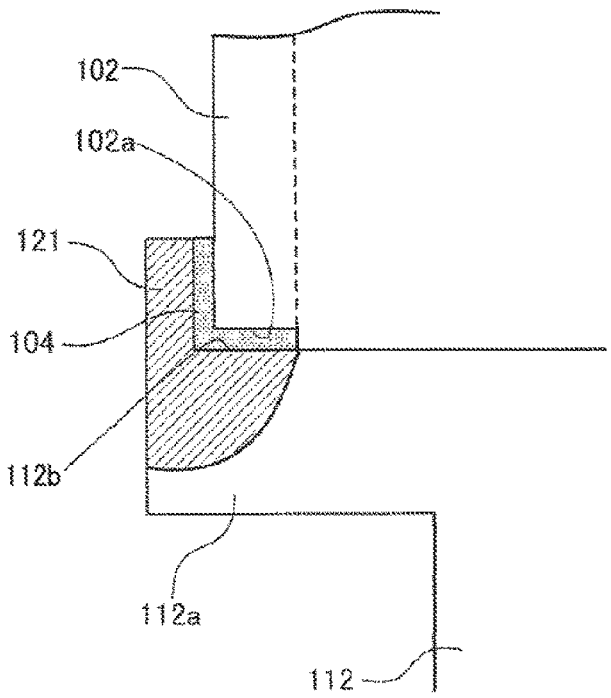
FIG. 5 is a cross-sectional view of a portion of the liquid discharge head cut along line X1-X1 in FIG. 4.
Figure 6:
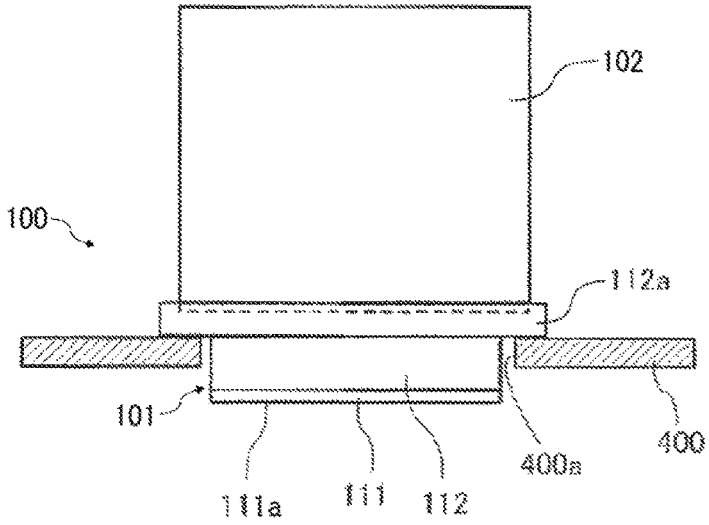
FIG. 6 is a side view of a state in which the liquid discharge head is mounted on a head mount.

Referring now to the drawings, wherein like reference numerals designate identical or corresponding parts throughout the several views, embodiments of the present disclosure are described below. A liquid discharge head according to a first embodiment of the present disclosure is described with reference to FIGS. 1 to 5. FIG. 1 is a perspective view of the liquid discharge head according to the first embodiment. FIG. 2 is a side view of the liquid discharge head. FIG. 3 is a perspective view of a head body of the liquid discharge head. FIG. 4 is a plan view of the liquid discharge head. FIG. 5 is a cross-sectional view of a portion of the liquid discharge head cut along line X1-X1 in FIG. 4. FIG. 6 is a side view of a state in which the liquid discharge head is mounted on a head mount.

The liquid discharge head 100 includes a head body 101 and a cover 102. The cover 102 covers a liquid supply channel substrate and an electric component (electric circuit board) on the head body 101. The electric circuit board is, for example, a rigid circuit board or a flexible circuit board.

The head body 101 includes a liquid discharge portion 111 to discharge liquid and a frame 112 as a frame of the head body 101. The frame 112 is disposed at an opposite side of a nozzle face 111*a* from which liquid is discharged, and also acts as a member in which a common liquid chamber is formed to supply liquid to the liquid discharge portion 111.

In the present embodiment, a flange (collar) 112*a* is disposed on an outer peripheral portion of the frame 112.

As illustrated in FIG. 6, when the head body 101 is fitted in an opening 400*a* of a head mount 400, such as a carriage or a base, to mount the liquid discharge head 100 on the head mount 400, the flange 112*a* is supported by the head mount 400 and covers the opening 400*a*.

In the present embodiment, the flange 112*a* is disposed all around an outer peripheral portion of the head body 101 to cover the opening 400*a*. Covering the whole area of the opening 400*a* with the flange 112*a* can reduce mist from adhering to a side face of the head body 101 from a gap between the head body 101 and the opening 400*a* and entering the inside of the head body 101.

In the present embodiment, another face of the flange (collar) 112*a* the frame 112 of the head body 101, which is opposite the nozzle face 111*a*, is a mount face 112*b* on which the cover 102 is mounted.

The mount face 112*b* of the frame 112 has a rib 121 along and all around a peripheral surface (outer peripheral surface in the present embodiment) of the cover 102. As illustrated in FIG. 5, a bonded face 102*a* of the cover 102 is bonded to the mount face 112*b* of the frame 112 with an adhesive 104.

In the present embodiment, the adhesive 104 is also a sealer to seal a gap between the outer peripheral surface of the cover 102 and an inner peripheral surface of the rib 121.

Such a configuration can reliably prevent liquid from entering the inside from a gap between the frame 112 of the head body 101 and the cover 102. Accordingly, such a configuration can prevent damage to an electric or electronic circuit board disposed inside the cover 102.

In the present embodiment, since the adhesive 104 is also used as a sealer, the sealer (the adhesive 104 in the present embodiment) is disposed over a gap between the bonded face 102*a* of the cover 102 and the mount face 112*b* of the frame 112 and a gap between the outer peripheral surface of the cover 102 and the inner peripheral surface of the rib 121. Accordingly, as illustrated in FIG. 5, an area sealed with the sealer (the adhesive 104 in the present embodiment) has a bent structure.

As compared to the configuration in which only the gap between the outer peripheral surface of the cover 102 and the inner peripheral surface of the rib 121 is sealed, such a configuration increases routes through which liquid might enter the inside, thus more reliably preventing the entry of liquid.

As in the present embodiment, the configuration in which the rib 121 of the frame 112 is disposed at the outer peripheral side of the cover 102 can prevent the sealer (the adhesive 104 in the present embodiment) from easily flowing out to the outer peripheral portion of the frame 112.

In the present embodiment, the flange 112*a* is disposed all around the outer periphery of the head body 101 and the rib 121 is disposed all around the periphery of the flange 112*a*. Such a configuration can prevent liquid adhering to the outer peripheral surface of the frame 112 from easily reaching a bonded area of the frame 112 and the cover 102.

Note that, in the present embodiment, a gap between the outer peripheral surface of the cover 102 and the inner peripheral surface of the rib 121 is sealed with the adhesive 104 that bonds the cover 102 with the frame 112. However, in some embodiments, the gap between the outer peripheral surface of the cover 102 and the inner peripheral surface of the rib 121 may be sealed with a sealer other than the adhesive. The sealer may be, for example, a seal member made of an elastic material, such as rubber material.

In the present embodiment, the cover 102 is mounted on the frame 112 of the head body 101 by bonding the cover 102 to the frame 112 with the adhesive 104. However, the structure of mounting the cover 102 on the frame 112 is not limited to the bonding structure.

For example, a structure may be employed in which a flange disposed around the outer periphery of the cover 102 is screwed to the mount face 112*b* of the frame 112. Alternatively, a structure may be employed in which a recessed portion in one of the cover 102 and the frame 112 is recess-projection-fitted to a projecting portion of the other of the cover 102 and the frame 112.

For such a structure of screwing or recess-projection fitting, a gap between the outer peripheral surface of the cover 102 and the inner peripheral surface of the rib 121 is sealed with a sealer, such as epoxy resin.

Even in such a case, the sealer (the adhesive 104 in the present embodiment) may be disposed over a gap between a bonded surface (a surface in which the flange or the recessed or projecting portion is provided) and the mount face 112*b* of the frame 112 and a gap between the outer peripheral surface of the cover 102 and the inner peripheral surface of the rib 121.

Figure 7:
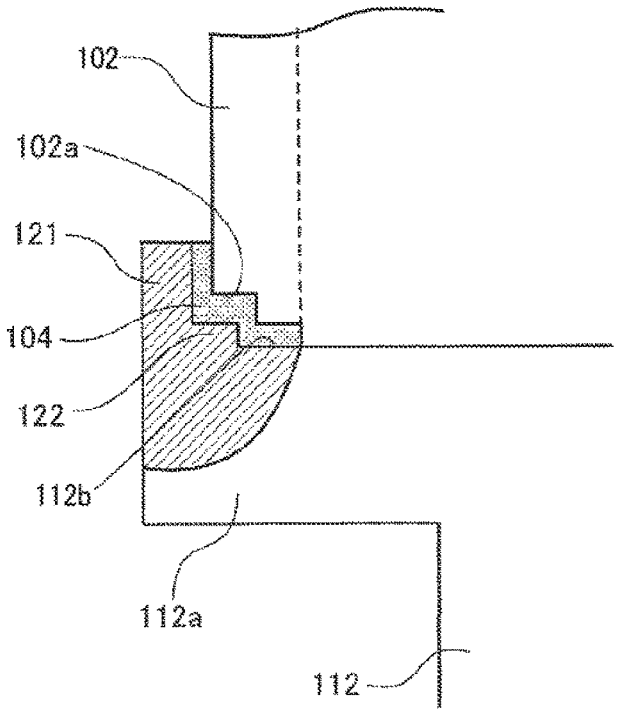
FIG. 7 is a cross-sectional view of a portion of the liquid discharge head according to a second embodiment of the present disclosure.

Next, the liquid discharge head according to a second embodiment of the present disclosure is described with reference to FIG. 7. FIG. 7 is a cross-sectional view of a portion of the liquid discharge head according to the second embodiment, cut similarly with FIG. 5.

In the present embodiment, a step portion 122 is disposed between the mount face 112*b* of the frame 112 and the rib 121. The bonded face 102*a* of the cover 102 has a stepped shape corresponding to the step portion 122.

Such a configuration increases the bonding area of the frame 112 and the cover 102 and the route through which liquid enters the inside, thus more reliably preventing the liquid from entering the inside.

In particular, when a solvent liquid is used, the solvent liquid may dissolve the adhesive. Hence, increasing the bonding area can enhance the durability against the solvent adhering to the surface side.

Figure 8:
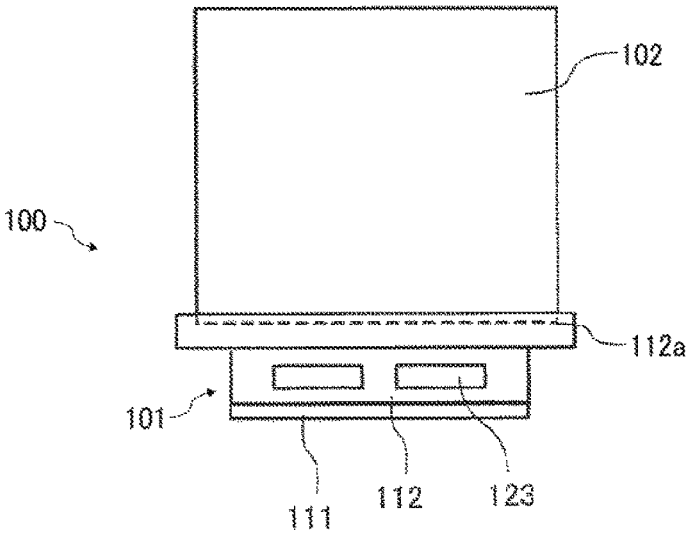
FIG. 8 is a side view of the liquid discharge head according to a third embodiment of the present disclosure.
Figure 9:
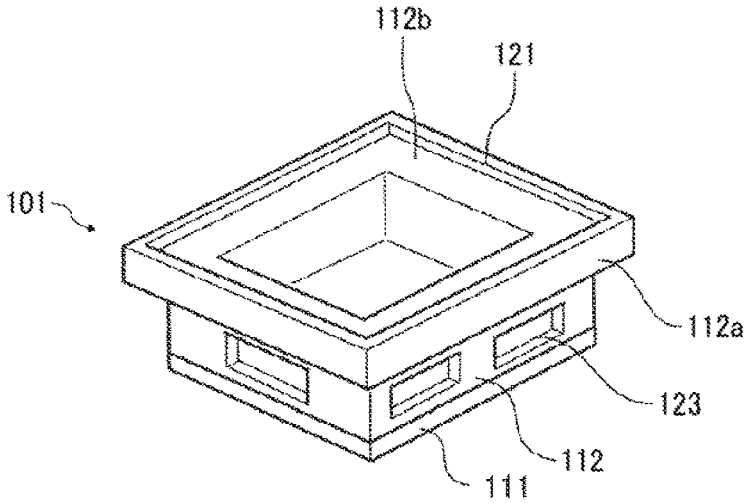
FIG. 9 is a perspective view of the head body in the third embodiment.

Next, the liquid discharge head according to a third embodiment of the present disclosure is described with reference to FIGS. 8 and 9. FIG. 8 is a side view of the liquid discharge head according to the third embodiment. FIG. 9 is a perspective view of the head body in the third embodiment.

In the present embodiment, a plurality of recessed portions 123 is disposed at outer side faces of the frame 112.

Accordingly, when an area around the nozzle face 111*a* is dipped and washed in a washing liquid, such a configuration can reduce the washing liquid reaching the bonded area of the frame 112 and the cover 102 along the outer peripheral surface of the frame 112.

Figure 10:
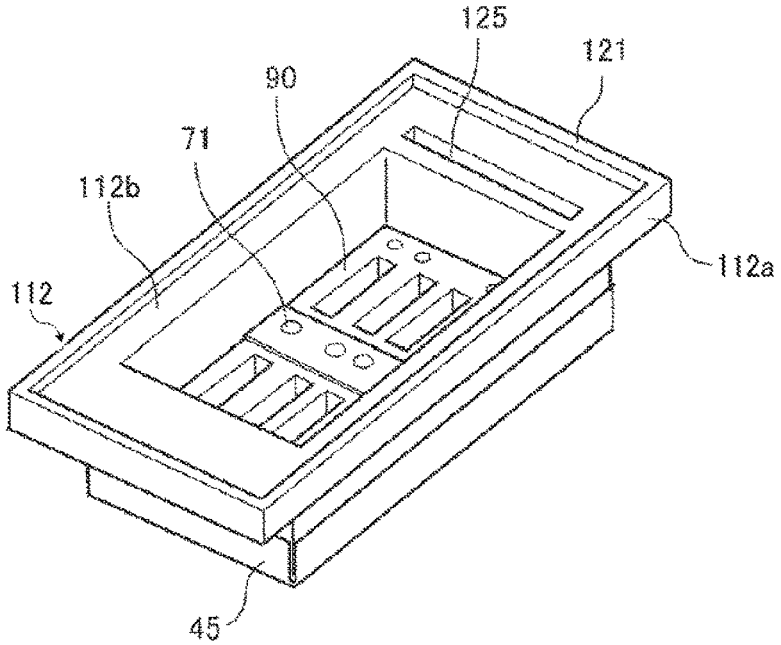
FIG. 10 is a perspective view of the head body according to an embodiment of the present disclosure.
Figure 11:
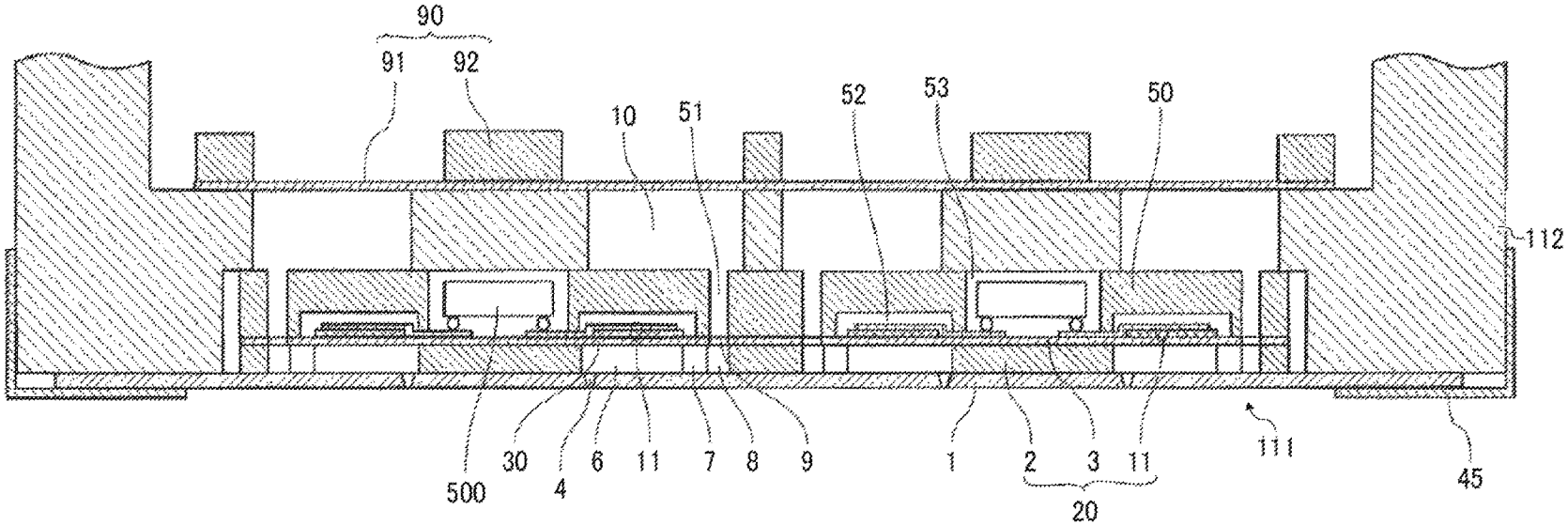
FIG. 11 is a cross-sectional view of the head body of FIG. 10, cut along a direction perpendicular to a nozzle array direction in which nozzles are arrayed in row.
Figure 12:
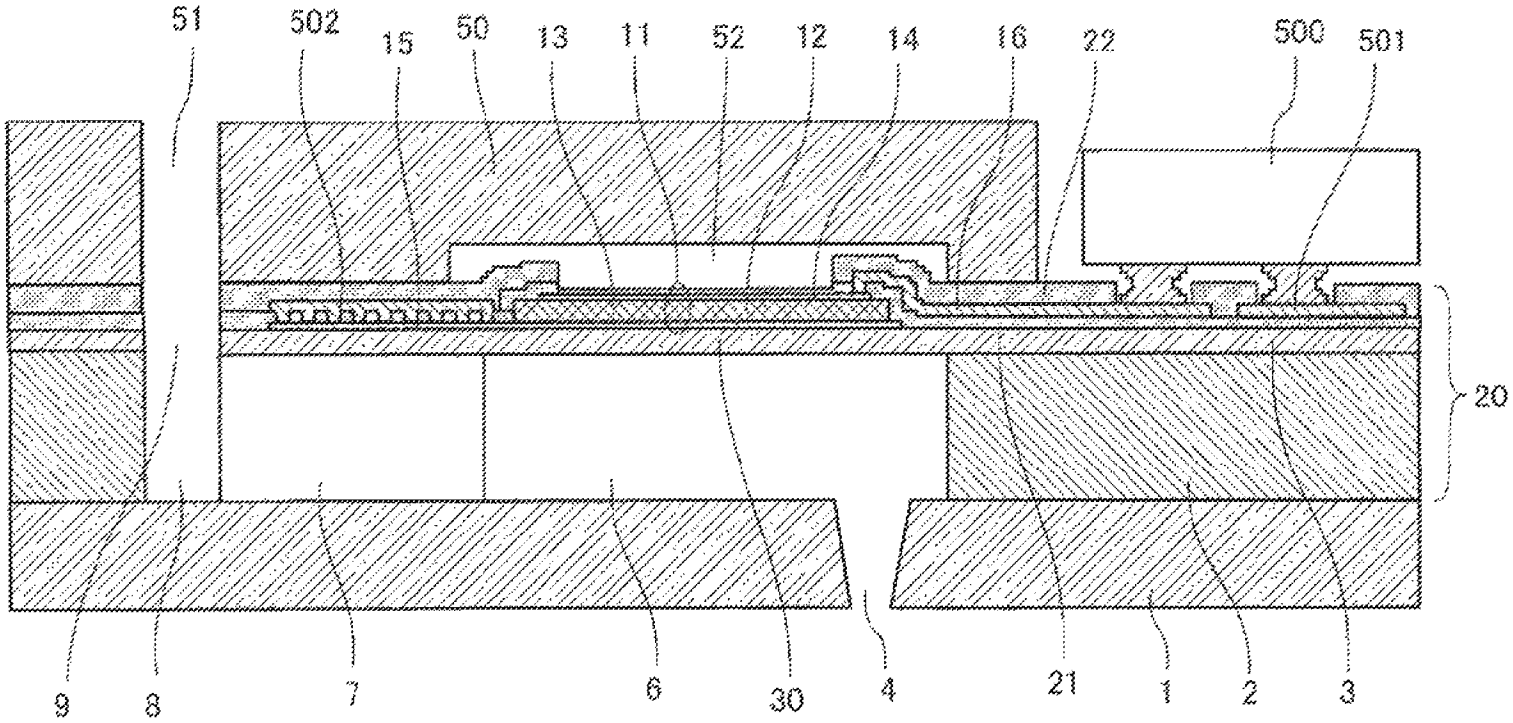
FIG. 12 is an enlarged cross-sectional view of a portion of the head body of FIG. 11.
Figure 13:
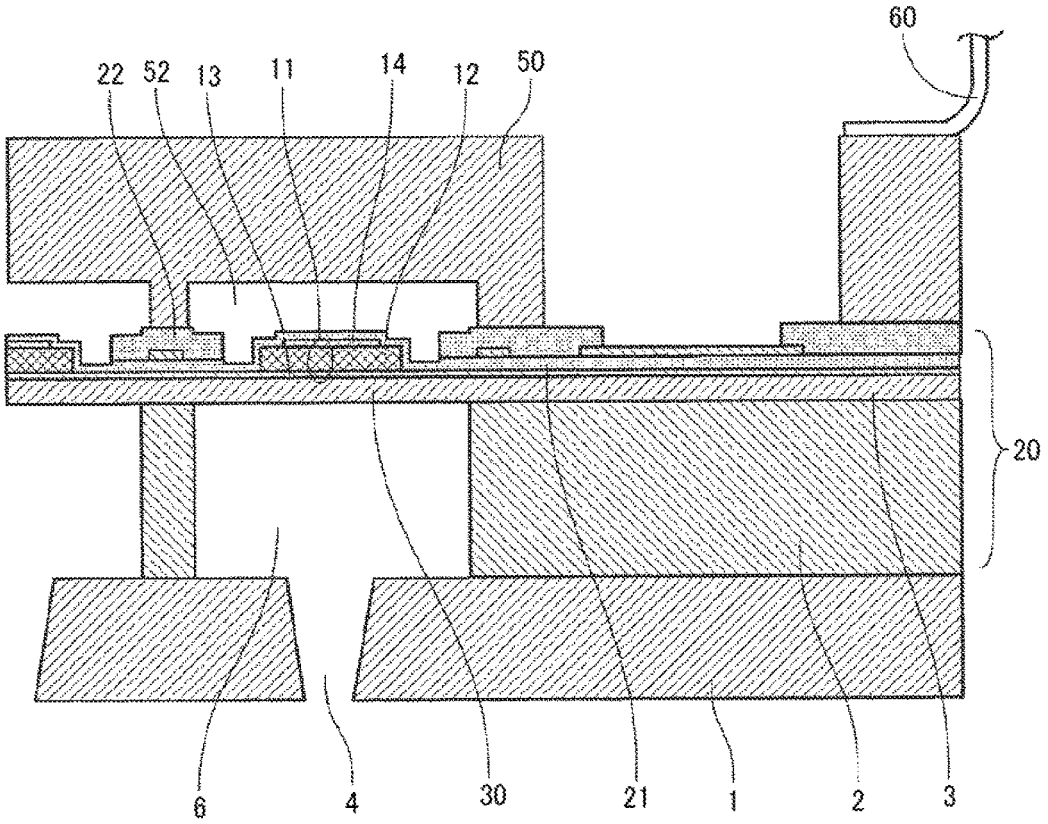
FIG. 13 is a cross-sectional view of a portion of the head body of FIG. 11 cut along the nozzle array direction.

Next, an example of the head body 101 is described with reference to FIGS. 10 to 13. FIG. 10 is a perspective view of the head body according to an embodiment of the present disclosure. FIG. 11 is a cross-sectional view of the head body of FIG. 10, cut along a direction perpendicular to a nozzle array direction in which nozzles are arrayed in row. FIG. 12 is an enlarged cross-sectional view of a portion of the head body of FIG. 11. FIG. 13 is a cross-sectional view of a portion of the head body cut along the nozzle array direction.

In this example, the head body 101 includes the liquid discharge portion 111 and the frame 112. The liquid discharge portion 111 includes a nozzle plate 1, a channel plate 2, a diaphragm plate 3, piezoelectric elements 11 as pressure generating elements, and a holding substrate 50.

Here, a part including the channel plate 2, the diaphragm plate 3, and the piezoelectric element 11 is referred to as a channel substrate (channel member) 20. Note that the channel substrate 20 does not include the nozzle plate 1 or the holding substrate 50 that is bonded to the channel substrate 20 after the channel substrate 20 is formed as an independent component.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid introduction portions 8 communicated with the fluid restrictors 7.

The liquid introduction portions 8 are communicated with the common liquid chambers 10 in the frame 112 via openings 9 of the diaphragm plate 3 and openings 51 as channels of the holding substrate 50.

The diaphragm plate 3 forms a deformable vibration portion 30 forming part of a wall face of the individual liquid chamber 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator.

In the piezoelectric element 11, a lower electrode 13, a piezoelectric layer (piezoelectric body) 12, and an upper electrode 14 are laminated in this order from the vibration portion 30. An insulation film 21 is disposed on the piezoelectric element 11.

The lower electrode 13 as a common electrode for the plurality of piezoelectric elements 11 is connected to a common-electrode power-supply wiring pattern 502 via a common wire 15. Note that, as illustrated in FIG. 12, the lower electrode 13 is a single electrode layer straddling all of the piezoelectric elements 11 in the nozzle array direction.

The upper electrodes 14 as discrete electrodes for the piezoelectric elements 11 are connected to a drive integrated circuit (IC) 500 (hereinafter, driver IC 500) as a drive circuit via individual wires 16. The individual wire 16 is covered with an insulation film 22.

The driver IC 500 is mounted on the channel substrate 20 by, e.g., a flip-chip bonding method, to cover an area between rows of the piezoelectric elements 11.

The driver IC 500 mounted on the channel substrate 20 is connected to a discrete-electrode power-supply wiring pattern 501 to which a drive waveform (drive signal) is supplied.

A leading end of the wiring member 60 is secured to the holding substrate 50 by, e.g., adhesive bonding and is connected to a wiring electrode on the channel substrate 20 through wire bonding to be electrically connected to the driver IC 500. The opposite end of the wiring member 60 is connected to a controller at an apparatus body side. The frame 112 has a slit 125 through which the wiring member 60 passes.

The wiring member 60 is connected to a control board at the apparatus body side via an electric circuit board, such as a printed circuit board (PCB), disposed on the frame 112. The electric circuit board and the wiring member 60 are covered with a cover bonded to the frame 112.

The openings 51 as channels communicating the common liquid chambers 10 with the individual liquid chambers 6 as described above, recessed portions 52 to accommodate the piezoelectric elements 11, and the holding substrate 50 including openings 53 to accommodate the driver ICs 500 are disposed on the channel substrate 20.

The holding substrate 50 is bonded to a side of the channel substrate 20 facing the diaphragm plate 3 with adhesive.

The frame 112 includes the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71.

A damper unit 90 is bonded to the frame 112. The damper unit 90 includes a damper 91 and damper plates 92. The damper 91 is deformable and forms part of wall faces of the common liquid chambers 10. The damper plates 92 reinforce the damper 91.

The frame 112 is bonded to an outer peripheral portion of the nozzle plate 1, to accommodate the channel substrate 20, including the piezoelectric elements 11, and the holding substrate 50, thus forming a frame of the liquid discharge head.

A protector 45 is disposed to cover an edge portion of the nozzle plate 1 and a part of the outer peripheral surface of the frame 112.

In the liquid discharge head, voltage is applied from the driver IC 500 to a portion between the upper electrode 14 and the lower electrode 13 of the piezoelectric element 11. Accordingly, the piezoelectric layer 12 expands in an electrode lamination direction (in other words, an electric-field direction) in which the upper electrode 14 and the lower electrode 13 are laminated, and contracts in a direction parallel to the vibration portion 30.

At this time, since a side (hereinafter, lower electrode 13 side) of the piezoelectric layer 12 facing the vibration portion 30 is bound by the vibration portion 30, a tensile stress arises at the lower electrode 13 side of the vibration portion 30, thus causing the vibration portion 30 to bend toward a side (hereinafter, individual liquid chamber 6 side) of the vibration portion 30 facing the individual liquid chamber 6. Accordingly, liquid within the individual liquid chamber 6 is pressurized and discharged from the nozzle 4.

Figure 14:
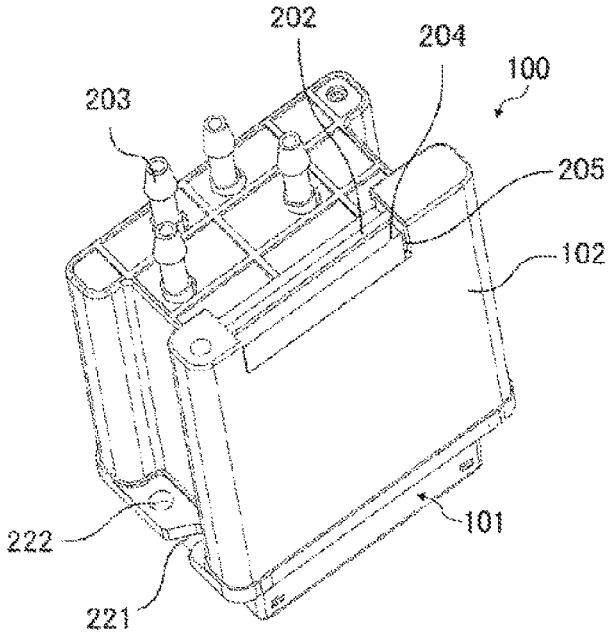
FIG. 14 is an outer perspective view of the liquid discharge head according to a fourth embodiment of the present disclosure.
Figure 15:
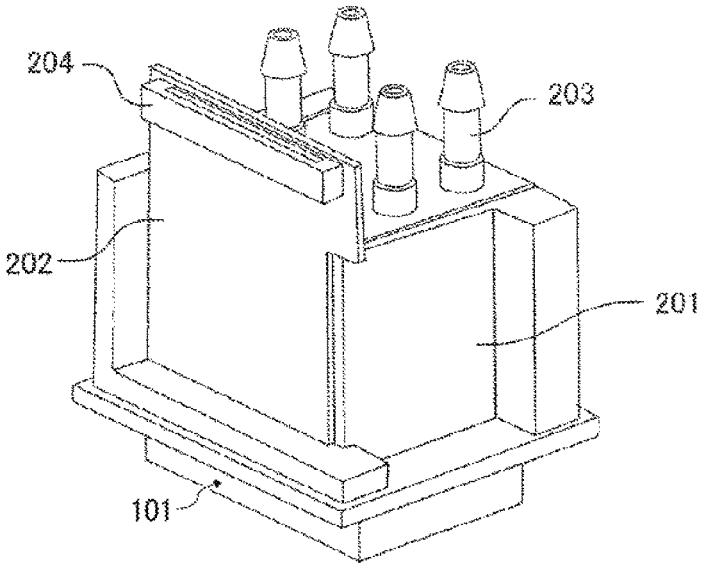
FIG. 15 is a schematic perspective view of the liquid discharge head in a state in which the cover is removed from the liquid discharge head of FIG. 14.
Figure 16:
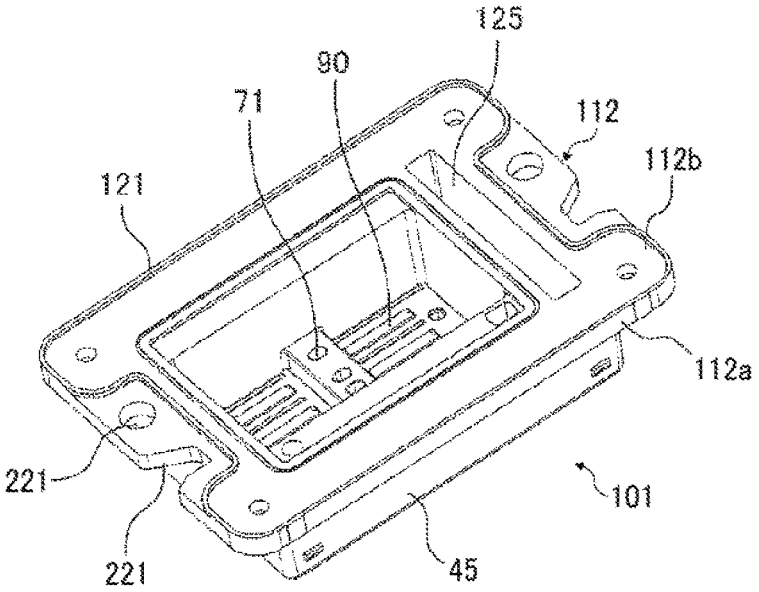
FIG. 16 is a perspective view of the head body of the liquid discharge head of FIG. 14.
Figure 17:
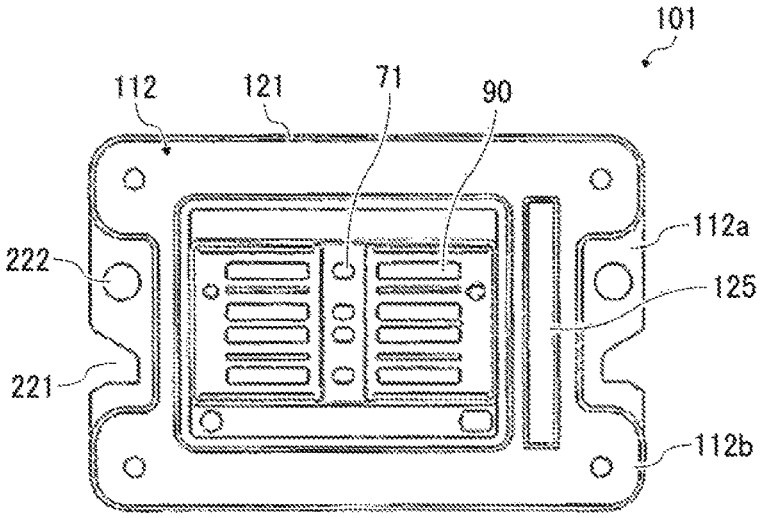
FIG. 17 is a plan view of the head body of FIG. 16.
Figure 18:
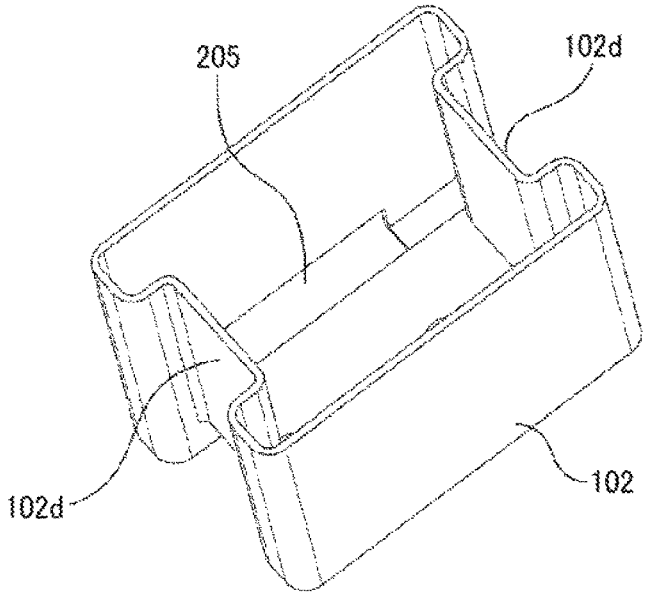
FIG. 18 is a perspective view of the cover of the liquid discharge head of FIG. 16, seen from the head body side.

Next, the liquid discharge head according to a fourth embodiment of the present disclosure is described with reference to FIGS. 14 to 18. FIG. 14 is an outer perspective view of the liquid discharge head according to the fourth embodiment. FIG. 15 is a schematic perspective view of the liquid discharge head in a state in which the cover is removed from the liquid discharge head. FIG. 16 is a perspective view of the head body of the liquid discharge head. FIG. 17 is a plan view of the head body. FIG. 18 is a perspective view of the cover of the liquid discharge head seen from the head body side.

The liquid discharge head 100 according to the present embodiment includes a head body 101 and a cover 102.

A liquid supply channel substrate 201 and a printed circuit board (wiring member) 202, which are disposed on the head body 101, are disposed in the cover 102. For example, the printed circuit board 202 is an electric circuit board to relay a main board, on which the controller of the apparatus body is mounted, to the wiring member 60 (see FIG. 13) connected to the piezoelectric elements of the head body 101. A circuit pattern to provide power supply voltage and control signals to a drive circuit of the head body 101 is formed on the printed circuit board 202. Note that the printed circuit board 202 as the electric circuit board may be any of a rigid circuit board and a flexible circuit board.

The liquid supply channel substrate 201 has inlet ports 203 connected to, e.g., an external liquid reservoir and an internal channel (liquid supply channel) connected to the liquid supply ports 71 of the head body 101, to supply liquid, which is supplied from the outside, to the head body 101.

The printed circuit board 202 includes a connector 204. The wiring member 60 (see FIG. 13) from the head body 101 side is laid around and connected to the connector 204. A connector of a relay cable connected to an external higher-level device (main board) is also connected to the connector 204. The cover 102 has an opening 205 corresponding to the connector 204.

The connector 204 is disposed at a position (near an upper end) of the printed circuit board 202 at a side opposite the head body 101 side in a normal direction to the mount face 112*b* of the frame 112.

With such a configuration, the connector 204 is disposed at a position away from the head body 101, thus reducing the adhesion of mist of liquid discharged from the head body 101 to the connector 204.

As described above, since the printed circuit board 202 as the electric circuit board is disposed inside the cover 102, it is necessary to prevent liquid from entering the inside of the cover 102 from between the head body 101 and the cover 102.

Hence, similarly with the above-described embodiment, the rib 121 is disposed along and all around the outer periphery of the cover 102, at the mount face (bonded face) 112*b* side of the flange (collar) 112*a* at which the frame 112 of the head body 101 is bonded to the cover 102.

The head body 101 and the cover 102 are bonded together with adhesive, and the adhesive as a sealer is filled in between the inner peripheral surface of the rib 121 and the outer peripheral surface of the cover 102.

The internal configuration of the head body 101 is similar to, even if not the same as, the internal configuration illustrated in FIGS. 10 to 13.

The frame 112 of the head body 101 has a notch 221 and a through-hole 222 near a center portion of each shorter side. When the liquid discharge head 100 is positioned, for example, the notches 221 are engaged with positioning pins or position adjustment cams. Through the through-holes 222, the liquid discharge head 100 is secured to a head mount member, such as a base, with fasteners.

The cover 102 has a concave portion 102*d*, which is inwardly recessed, at a center portion of each wall face along the short direction of the cover 102. In a state in which the cover 102 is secured to the frame 112, the notches 221 and the through-holes 222 of the frame 112 are placed at positions corresponding to the concave portions 102*d* of the cover 102. Accordingly, in the state in which the cover 102 is secured to the frame 112, a work can be performed to position and secure the liquid discharge head 100 to the base.

Figure 19:
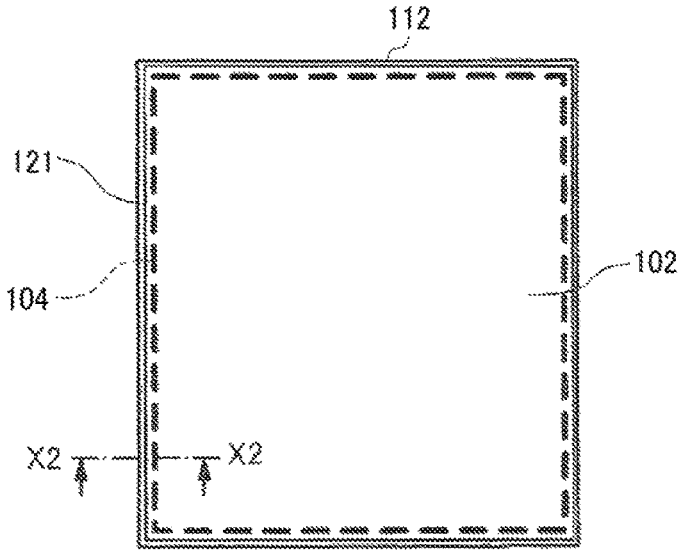
FIG. 19 is a plan view of the liquid discharge head according to a fifth embodiment of the present disclosure.
Figure 20:
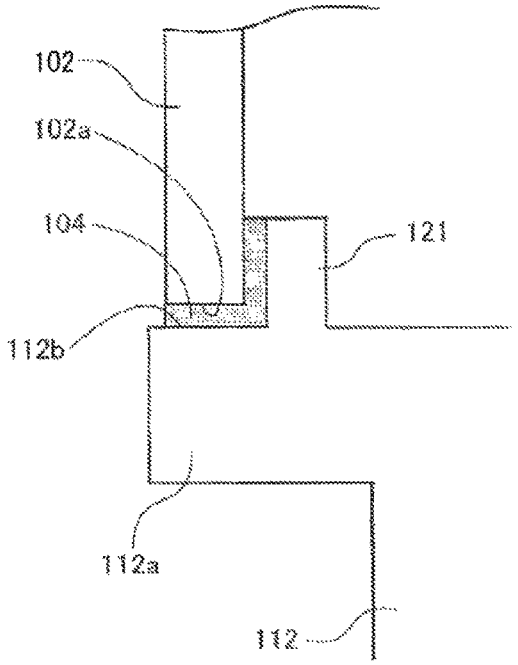
FIG. 20 is a cross-sectional view of a portion of the liquid discharge head, cut along line X2-X2 of FIG. 19.

Next, the liquid discharge head according to a fifth embodiment of the present disclosure is described with reference to FIGS. 19 and 20. FIG. 19 is a plan view of the liquid discharge head according to the fifth embodiment of the present disclosure. FIG. 20 is a cross-sectional view of a portion of the liquid discharge head, cut along line X2-X2 of FIG. 19.

In the present embodiment, the rib 121 is disposed along and all around the peripheral surface (the inner peripheral surface, in the present embodiment) of the cover 102 on the mount face 112*b*, which is a face of the flange 112*a* at an opposite side of the nozzle face 111*a*, of the frame 112 of the head body 101

As illustrated in FIG. 20, the bonded face 102*a* of the cover 102 covering the outer peripheral side of the rib 121 is bonded to the mount face 112*b* of the frame 112 with the adhesive 104.

In the present embodiment, the adhesive 104 is also a sealer to seal a gap between the inner peripheral surface of the cover 102 and the outer peripheral surface of the rib 121.

In the present embodiment, as compared with a configuration not including the rib 121, the sealing area of the sealer increases, thus reliably preventing liquid from entering the inside from between the frame 112 and the cover 102.

In the present embodiment, since the adhesive 104 is disposed over a gap between the bonded face 102*a* of the cover 102 and the mount face 112*b* of the frame 112 and a gap between the inner peripheral surface of the cover 102 and the outer peripheral surface of the rib 121. Accordingly, as illustrated in FIG. 20, an area sealed with the sealer (the adhesive 104 in the present embodiment) has a bent structure.

As compared to the configuration in which only the gap between the outer peripheral surface of the cover 102 and the inner peripheral surface of the rib 121 is sealed, such a configuration increases routes through which liquid might enter the inside, thus more reliably preventing the entry of liquid.

Figure 21:
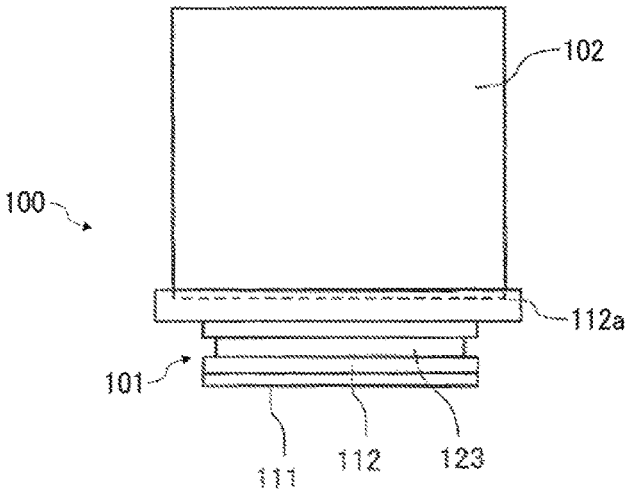
FIG. 21 is a side view of the liquid discharge head according to a sixth embodiment of the present disclosure.
Figure 22:
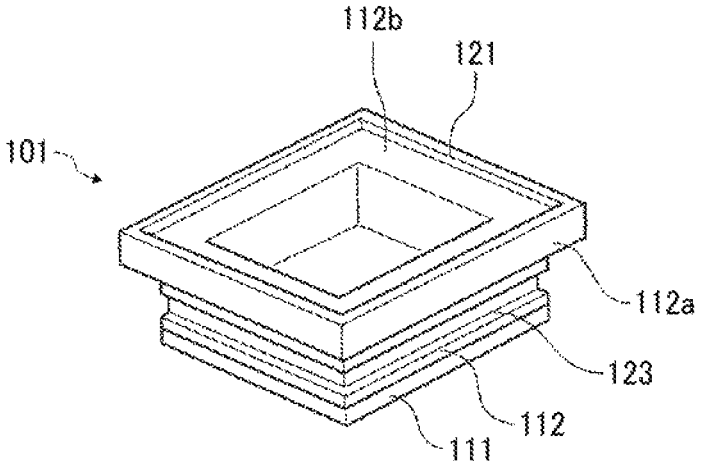
FIG. 22 is a perspective view of the head body in the sixth embodiment.

Next, the liquid discharge head according to a sixth embodiment of the present disclosure is described with reference to FIGS. 21 and 22. FIG. 21 is a side view of the liquid discharge head according to the sixth embodiment. FIG. 22 is a perspective view of the head body in the sixth embodiment.

For the present embodiment, in the configuration of the above-described third embodiment, the recessed portion 123 is formed in a band shape all around an outer side faces of the frame 112.

Accordingly, when an area around the nozzle face 111*a* is dipped and washed in a washing liquid, such a configuration can more reliably prevent the washing liquid from reaching the bonded area of the frame 112 and the cover 102 along the outer peripheral surface of the frame 112.

Figure 23:
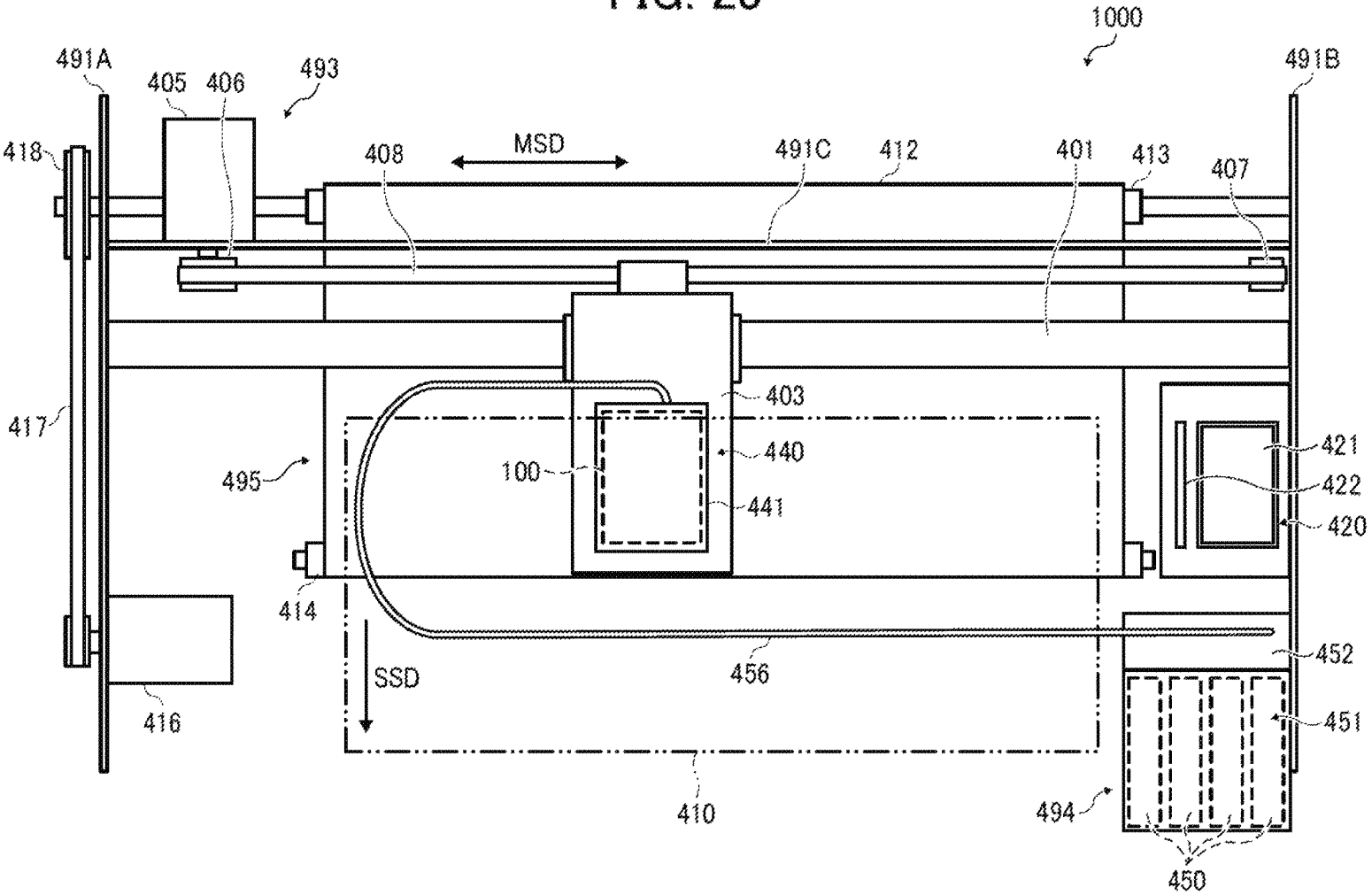
FIG. 23 is a plan view of a portion of a liquid discharge apparatus according to an embodiment of the present disclosure.
Figure 24:
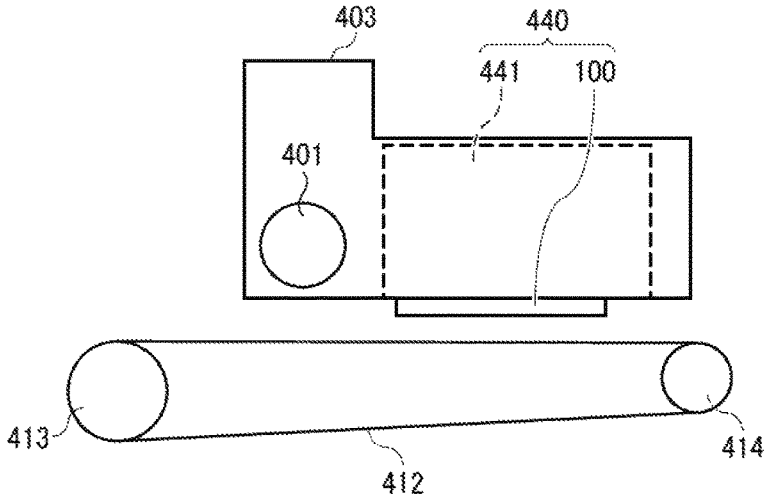
FIG. 24 is a side view of a portion of the liquid discharge apparatus of FIG. 23.

Next, a liquid discharge apparatus according to an embodiment of the present disclosure is described with reference to FIGS. 23 and 24. FIG. 23 is a plan view of a portion of the liquid discharge apparatus according to an embodiment of the present disclosure. FIG. 24 is a side view of a portion of the liquid discharge apparatus of FIG. 23.

A liquid discharge apparatus 1000 according to the present embodiment is a serial-type apparatus in which a main scan moving unit 493 reciprocally moves a carriage 403 in a main scanning direction indicated by arrow MSD in FIG. 23. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 100 according to an embodiment of the present disclosure and a head tank 441 are integrated as a single unit. The liquid discharge head 100 of the liquid discharge device 440 discharges ink droplets of respective colors of yellow (Y), cyan (C), magenta (M), and black (K). The liquid discharge head 100 includes nozzle rows, each including a plurality of nozzles 4 arrayed in row in a sub-scanning direction, which is indicated by arrow SSD in FIG. 23, perpendicular to the main scanning direction MSD. The liquid discharge head 100 is mounted to the carriage 403 so that ink droplets are discharged downward.

The liquid stored outside the liquid discharge head 100 is supplied to the liquid discharge head 100 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump.

The liquid cartridge 450 is detachably attached to the cartridge holder 451. The liquid is supplied to the head tank 441 by the liquid feed unit 452 via the tube 456 from the liquid cartridge 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 attracts the sheet 410 and conveys the sheet 410 at a position facing the liquid discharge head 100. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 100 in good condition is disposed on a lateral side of the conveyance belt 412.

The maintenance unit 420 includes, for example, a cap 421 to cap a nozzle face (i.e., a face on which the nozzles are formed) of the liquid discharge head 100 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, a sheet 410 is conveyed on and attracted to the conveyance belt 412 and is conveyed in the sub-scanning direction SSD by the cyclic rotation of the conveyance belt 412.

The liquid discharge head 100 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 100 according to an embodiment of the present disclosure, thus allowing stable formation of high quality images.

Figure 25:
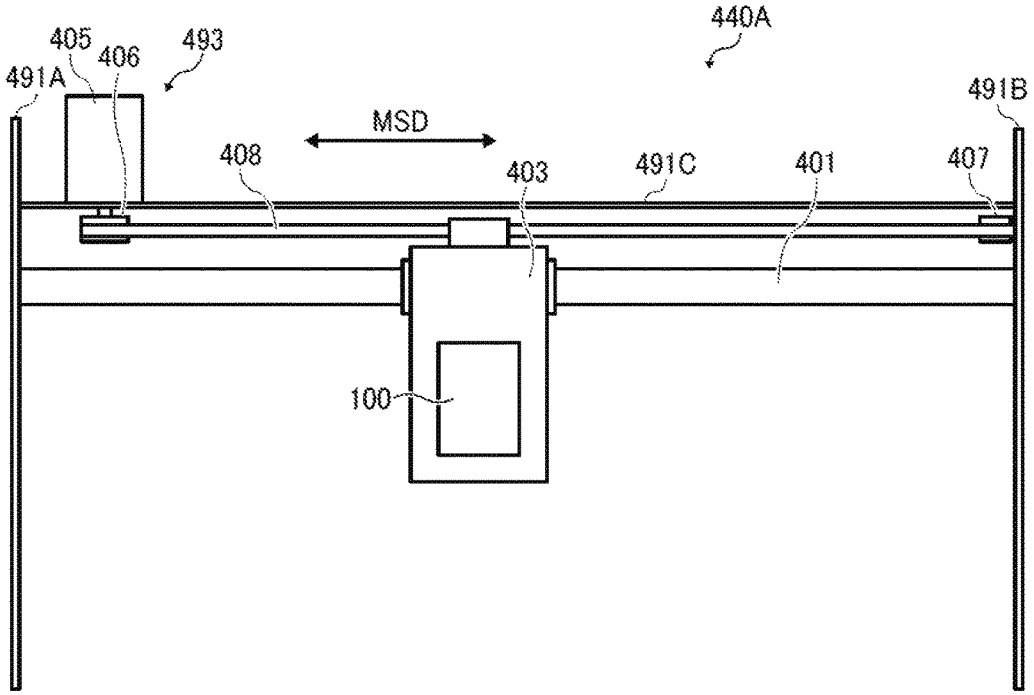
FIG. 25 is a plan view of a portion of another example of the liquid discharge device.

Next, another example of the liquid discharge device according to an embodiment of the present disclosure is described with reference to FIG. 25. FIG. 25 is a plan view of a portion of another example of the liquid discharge device (liquid discharge device 440A).

The liquid discharge device 440A includes the housing, the main scan moving unit 493, the carriage 403, and the liquid discharge head 100 among components of the liquid discharge apparatus 1000. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 26:
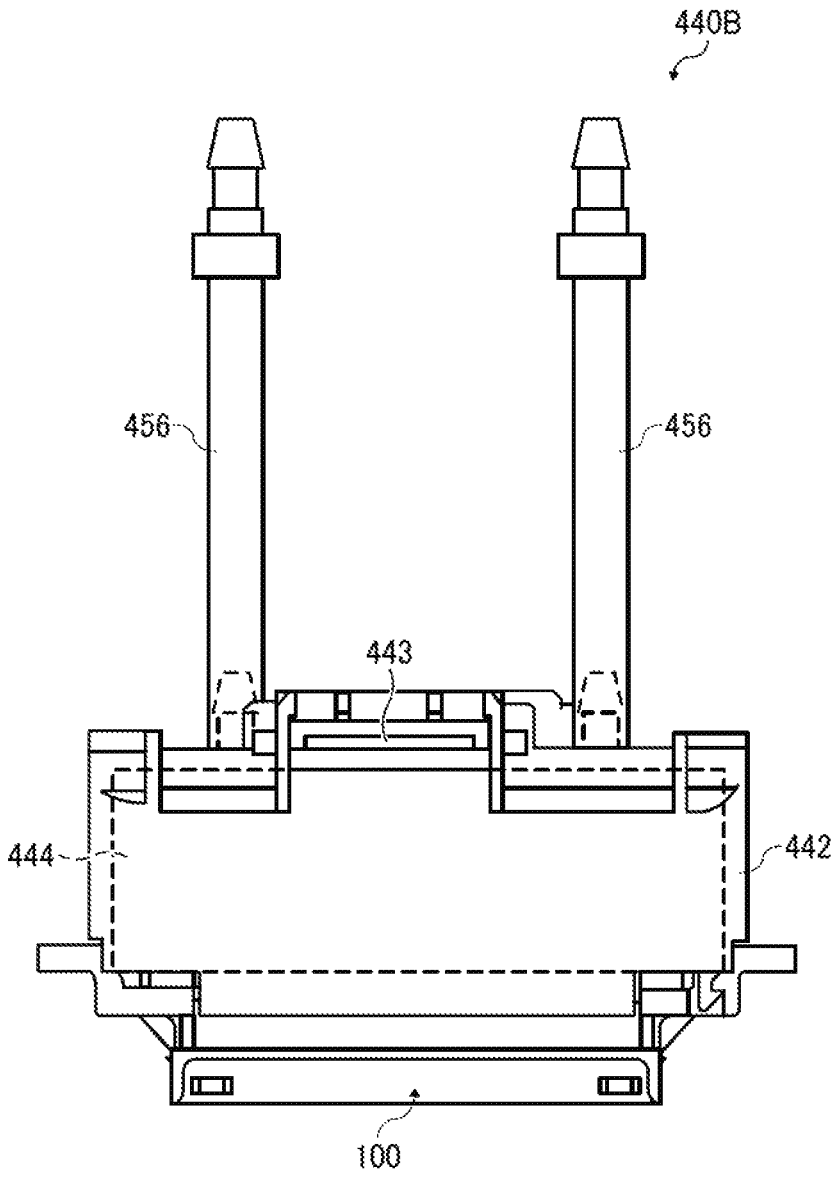
FIG. 26 is a front view of still another example of the liquid discharge device.

Next, still another example of the liquid discharge device according to an embodiment of the present disclosure is described with reference to FIG. 26. FIG. 26 is a front view of still another example of the liquid discharge device (liquid discharge device 440B).

The liquid discharge device 440B includes the liquid discharge head 100 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 100 to a power source is disposed above the channel part 444.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The liquid discharge device is an integrated unit including the liquid discharge head and a functional part(s) or unit(s), and is an assembly of parts relating to liquid discharge. For example, the liquid discharge device may be a combination of the liquid discharge head (e.g., the liquid discharge head 100) with at least one of a head tank (e.g., the head tank 441), a carriage (e.g., the carriage 403), a supply unit, a maintenance unit (e.g., the maintenance unit 420), and a main scan moving unit (e.g., the main scan moving unit 493).

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via. e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main scan moving unit, so that the liquid discharge head and the main scan moving unit are integrated as a single unit. The liquid discharge device may include the liquid discharge head, the carriage, and the main scan moving unit that are integrated as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head through the tube.

The main scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional fabricating apparatus (solid-object fabricating apparatus) to discharge a fabrication liquid to a powder layer in which powder material is formed in layers, so as to form a three-dimensional fabrication object (solid fabrication object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head to discharge liquid in a discharge direction, the liquid discharge head comprising:
- a head body including:
  - a frame including a mount side and a discharge side opposite to the mount side; and
  - a nozzle face disposed at the discharge side of the frame, the nozzle face being configured to discharge liquid therethrough;
- a cover mounted onto the mount side of the frame of the head body, the mount side to which the cover is mounted being disposed between the cover and the nozzle face;
- a rib disposed at the frame along a peripheral surface of the cover; and
- a sealer disposed between the peripheral surface of the cover and a peripheral surface of the rib.

2. The liquid discharge head according to claim 1, wherein the sealer is disposed between an inner peripheral surface of the rib and an outer peripheral surface of the cover.

3. The liquid discharge head according to claim 1, wherein the sealer is an adhesive to bond the frame to the cover.

4. The liquid discharge head according to claim 1, further comprising a step portion between the rib and the cover.

5. The liquid discharge head according to claim 1, further comprising a flange at an outer peripheral portion of the frame, wherein the rib is disposed at the flange.

6. The liquid discharge head according to claim 5, wherein the flange is disposed all around the outer peripheral portion of the frame, and wherein the rib is disposed all around a periphery of the flange.

7. The liquid discharge head according to claim 1, wherein the sealer is disposed between the peripheral surface of the cover and the peripheral surface of the rib and between the cover and a cover mount face of the frame on which the cover is mounted.

8. The liquid discharge head according to claim 1, further comprising a recessed portion in an outer side face of the frame.

9. The liquid discharge head according to claim 8, wherein the recessed portion is disposed all around the outer side face of the frame.

10. The liquid discharge head according to claim 1, further comprising an electric circuit board mounted on the frame of the head body, wherein the cover covers the electric circuit board.

11. The liquid discharge head according to claim 10, further comprising a connector on the electric circuit board to connect a cable, wherein the connector is disposed at an end of the electric circuit board, and wherein the end of the electric circuit board is at a side opposite a side at which the head body is disposed.

12. A liquid discharge device comprising the liquid discharge head according to claim 1.

13. The liquid discharge device according to claim 12, wherein the liquid discharge head is integrated as a single unit with at least one of:

a head tank to store liquid to be supplied to the liquid discharge head;

a carriage on which the liquid discharge head is mounted;

a supply unit to supply the liquid to the liquid discharge head;

a maintenance unit to maintain the liquid discharge head; and a main scan moving unit to move the liquid discharge head in a main scanning direction.

14. A liquid discharge apparatus comprising the liquid discharge device according to claim 12 to discharge liquid.

15. A liquid discharge apparatus comprising the liquid discharge head according to claim 1 to discharge liquid.

16. A liquid discharge device comprising:

a liquid source to supply liquid to be discharged; and a liquid discharge head to discharge the liquid in a discharge direction, the liquid discharge head comprising:

a head body including:

a frame including a mount side and a discharge side opposite to the mount side; and a nozzle face disposed at the discharge side of the frame, the nozzle face being configured to discharge liquid therethrough;

a cover mounted onto the mount side of the frame of the head body, the mount side to which the cover is mounted being disposed between the cover and the nozzle face;

a rib disposed at the frame along a peripheral surface of the cover; and a sealer disposed between the peripheral surface of the cover and a peripheral surface of the rib.

17. A liquid discharge apparatus comprising:

a carriage; and a liquid discharge head mounted to the carriage, to discharge liquid in a discharge direction, the liquid discharge head comprising:

a head body including:

a frame including a mount side and a discharge side opposite to the mount side; and a nozzle face disposed at the discharge side of the frame, the nozzle face being configured to discharge liquid therethrough;

a cover mounted onto the mount side of the frame of the head body, the mount side to which the cover is mounted being disposed between the cover and the nozzle face;

a rib disposed at the frame along a peripheral surface of the cover; and a sealer disposed between the peripheral surface of the cover and a peripheral surface of the rib.

* * * * *